US005838290A

United States Patent [19]

Kuijk

[11] Patent Number: 5,838,290

[45] Date of Patent: Nov. 17, 1998

[54] DISPLAY DEVICE WITH PHOTOVOLTAIC CONVERTER

[75] Inventor: Karel E. Kuijk, Eindhoven, Netherlands

[73] Assignee: U.S. Philips Corporation, New York, N.Y.

[21] Appl. No.: 812,186

[22] Filed: Mar. 6, 1997

[30] Foreign Application Priority Data

Mar. 18, 1996 [EP] European Pat. Off. ..... 96200745

[51] Int. Cl.[6] ..... G09G 1/28

[52] U.S. Cl. ..... 345/91; 345/207

[58] Field of Search ..... 345/76, 55, 81, 345/100, 91, 87, 84, 92, 96, 97, 207, 104; 250/211; 348/314, 294, 297, 302, 307; 358/513

[56] References Cited

U.S. PATENT DOCUMENTS

| | | | |
|---|---|---|---|
| 3,947,842 | 3/1976 | Hilsum et al. | 345/81 |
| 3,972,040 | 7/1976 | Hilsum et al. | 345/76 |
| 4,345,248 | 8/1982 | Togashi et al. | 345/207 |
| 4,376,888 | 3/1983 | Fukuda et al. | 250/211 |
| 4,976,515 | 12/1990 | Hartmann | 350/333 |
| 5,151,691 | 9/1992 | Kuijk | 340/784 |
| 5,446,564 | 8/1995 | Mawatari et al. | 345/91 |
| 5,485,177 | 1/1996 | Shannon et al. | 345/207 |

*Primary Examiner*—Steven J. Saras
*Assistant Examiner*—John Suraci
*Attorney, Agent, or Firm*—F. Brice Faller

[57] ABSTRACT

A display device in which an internal auxiliary voltage, which is used for controlling, is obtained via photovoltaic converter.

9 Claims, 3 Drawing Sheets

DISPLAY DEVICE WITH PHOTOVOLTAIC CONVERTER

BACKGROUND OF THE INVENTION

The invention relates to a display device comprising an electro-optical medium between a first supporting plate and a second supporting plate, which display device is provided with pixels which are arranged in rows and columns, a pixel being defined by picture electrodes on surfaces of the supporting plates facing each other, and every pixel being coupled to a column electrode or a row electrode via a switching element.

Such a display device can suitably be used, for example, to display alpha-numerical information and to display video information by means of passive electro-optical media such as liquid crystals, electrophoretic materials and electrochromic materials.

A display device of the type mentioned in the opening paragraph is described in U.S. Pat. No. 5,151,691. On a first supporting plate of said display device, a picture electrode is coupled via a first, non-linear two-pole switching element to a row electrode and via a second, non-linear two-pole switching element to an electrode for an auxiliary voltage which is common to pixels of the same row. The display device additionally comprises drive means for applying data voltages and selection voltages to, respectively, the column electrodes and row electrodes to apply a voltage across the pixel within a voltage range for picture display, and means for charging the pixel, prior to selection of the pixel, to a voltage at the boundary of or beyond the voltage range for picture display. In said display device, the means for charging the pixel, prior to selection, to a voltage at the boundary of or beyond the range for picture display (also referred to as "resetting") comprise a divided capacitance between the row electrodes and the common electrode for each row of pixels. In addition, each common electrode is connected to a reference voltage via an additional diode to periodically recharge said capacitance. Particularly in devices having larger dimensions (having a picture diameter of 40 cm or more) the charge stored in said capacitance for resetting must be large enough to supply the current necessary for resetting. Besides, as described in said Patent Specification, voltage drop across the pixels as a result of switching effects must be minimized. To this end, the width of the row electrode in U.S. Pat. No. 5,151,691 is approximately 1/15 of the height of a pixel. This is at the expense of the aperture.

In addition, the provision of the capacitance requires additional process steps, while recharging the capacitances requires an additional diode for each row of pixels.

It is an object of the invention to provide, inter alia, a display device of the type mentioned in the opening paragraph, in which one or more of the above problems are largely precluded. This is achieved by a display device in accordance with the invention, which is characterized in that a photovoltaic converter is provided between the column or row electrode and an electrode for an auxiliary voltage.

A photovoltaic converter is to be understood to mean herein, for example, a photocell or photodiode or an assembly of these elements, or any other element which supplies current when exposed to light.

A first embodiment of the invention is characterized in that almost every picture electrode on the first supporting plate is coupled to the row electrode via a first, nonlinear two-pole switching element, and to an electrode for the auxiliary voltage which is common to pixels of the same row via a second, non-linear two-pole switching element.

The invention utilizes the presence, in general, of a light source, for example on the rear side (backlight), in LCD display devices (but also in other types of displays); the light supplied by the light source is sufficient to cause such a photovoltaic effect that sufficient current is supplied to bring about resetting in the type of display device described in U.S. Pat. No. 5,151,196.

The provision of a photovoltaic converter (photogenerator) between the common electrode and the row electrode in combination with the voltage on the row electrode and the voltage generated by the photovoltaic converter enables the auxiliary voltage to be created on the common electrode with which the row of pixels within a row is reset without the presence of the (divided) capacitance being required. This means that the width of the row electrodes can be chosen to be smaller (the dimension of the pixels remaining the same), so that a larger aperture is obtained. This has the advantage that, although the power of the light source remains the same, a greater brightness is obtained. This has advantages, in particular, in display devices having a high-power light source, such as display devices having picture diameters of 40 cm or more, but also with picture diameters in excess of, for example, 25 cm an improvement is obtained. Moreover, in the case of considerably larger pixels or display devices having a larger number of columns, in which more current must be supplied for resetting, this greater amount of current can be obtained in a simple manner by adapting the photovoltaic converter (for example by enlarging the surface of photodiodes).

A second embodiment of the invention is characterized in that almost every picture electrode on the first supporting plate is coupled to the row electrode via an TFT switching element, a gate electrode of the switching element being coupled to an electrode for the auxiliary voltage which is common to pixels of the same row. Upon exposure to a light source, which, during operation, periodically illuminates, in the row direction, the photovoltaic converters associated with successive selection, the forward voltage of the photovoltaic converter varies such as to cause the TFT transistors to switch on during illumination and remain switched off without illumination. By virtue thereof, a display element without the customary, large number of row electrodes can be produced.

These and other aspects of the invention will be apparent from and elucidated with reference to the embodiments described hereinafter.

BRIEF DESCRIPTION OF THE DRAWINGS

In the drawings.

The Figures are not drawn to scale; like reference numerals generally refer to like parts.

DESCRIPTION OF THE PREFERRED EMBODIMENTS

Figure 1:
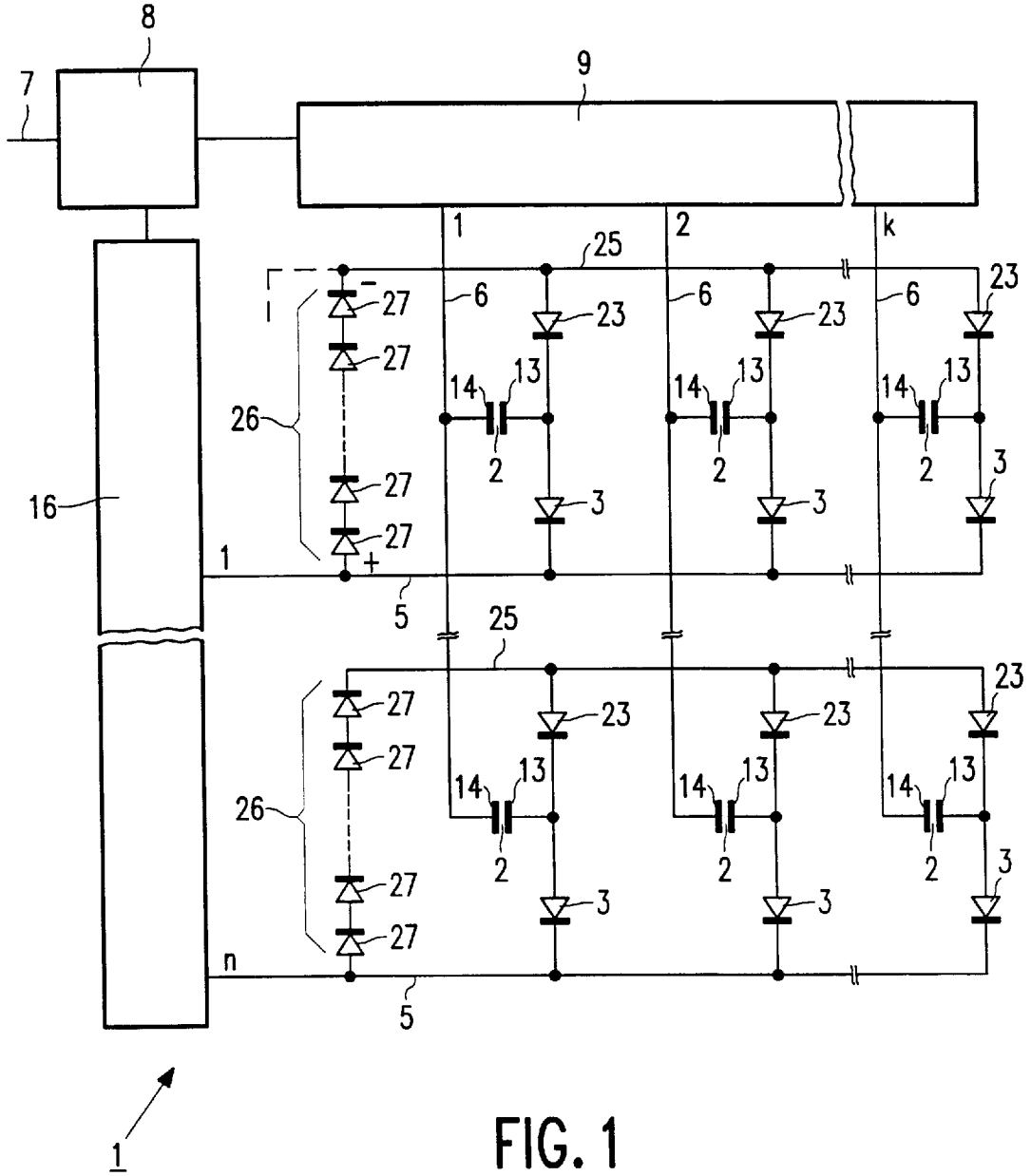
FIG. 1 schematically shows an equivalent circuit diagram of a part of a display device in accordance with the invention, FIG. 2 schematically shows, in cross-section, a part of a display device in accordance with the invention, while FIG. 3 schematically shows, in cross-section, another part of the display device of FIG. 2, and FIG. 4 schematically shows an equivalent circuit diagram of a part of another display device in accordance with the invention.

FIG. 1 schematically shows an electrical equivalent circuit diagram of a part of a display device 1. This device comprises a matrix of pixels 2 which are arranged in n rows and k columns. In this example, the pixels 2 are connected to row electrodes 5 via non-linear, two-pole switching elements, in this example diodes 3. A row of pixels is selected via the row electrodes 5, which select the relevant rows. The row electrodes are successively selected by means of a multiplex circuit 16.

Incoming (video) information 7 is stored in a data register 9, after having been processed, if necessary, in a processing/control unit 8. The voltages supplied by the data register 9 to column electrodes 6 cover a voltage range which is sufficient to adjust the desired range of grey levels. As a result, during selection, pixels 2 are charged, dependent upon the voltage difference between the picture electrodes 13, 14 and the duration of the pulse determining the information. In this example, the picture electrodes 14 form a common column electrode 5. The pixels 2 within a row are further connected to a common electrode 25 via non-linear, two-pole switching elements, in this examples diodes 23. In accordance with the invention, a photovoltaic converter which, in this case, comprises various photosensitive diodes 27, is situated between every row electrode 5 and the common electrode 25 coupled to the associated picture electrodes.

Figure 2:
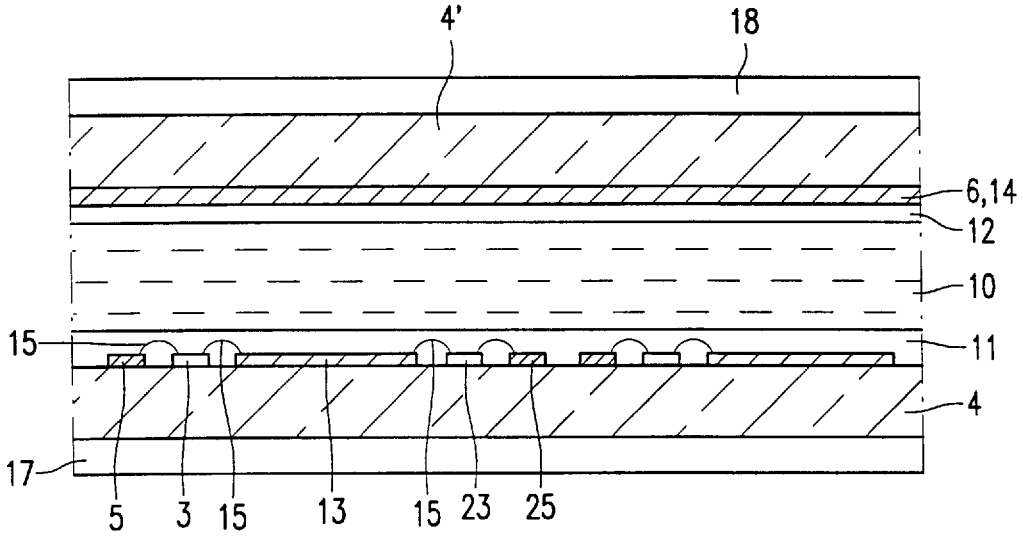
Figure 3:
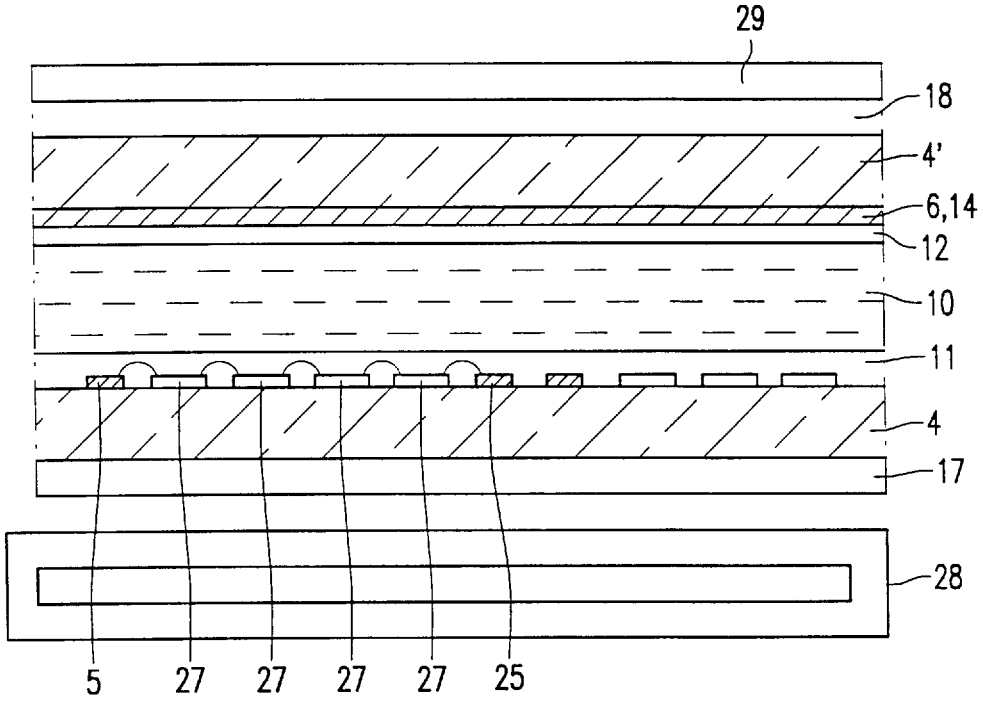

FIG. 2 schematically shows, in cross-section, a part of a liquid-crystal display device 1 in accordance with the invention, which comprises a twisted-nematic liquid-crystal material 10 which is sandwiched between first and second supporting plates 4, 4', for example, of glass, which are provided with picture electrodes 13 and 14. These picture electrodes are connected on the one hand, via diodes 3, to row electrodes 5 for supplying selection signals. To supply data signals, the picture electrodes 14 are connected to column electrodes 6 which, in this example, are in the form of common, strip-shaped electrodes.

In this example, the picture electrodes on the first supporting plate 4 are connected on the other hand, via diodes 23, to a number of series-connected photo-sensitive diodes 27 which together form the photogenerator 26. These diodes are made of amorphous silicon and may be, for example, pin diodes or Schottky diodes. In either case, the diodes can be constructed as lateral diodes. The diodes for the switching function (diodes 3, 23) and the diodes for the photogenerator (diodes 27) are manufactured in the same process.

The device, which in this case is of the transmissive type, further comprises a light source (backlight or sidelight), not shown in FIG. 2, and two polarizers 17, 18 having mutually perpendicular directions of polarization. The device further comprises orientation layers 11, 12, which orient the liquid-crystal material at the inner surfaces of the substrate, in this example, in the direction of the polarization axes of the polarizers, so that the cell has a twist angle, for example, of 90 degrees. In this case, the liquid-crystal material has a positive optical anisotropy and a positive dielectric anisotropy.

In another part of the device, a number (in this case 4) of series-connected photo-sensitive diodes 27, which together form a photovoltaic converter (photogenerator), are situated between each row electrode 5 and the common electrode 25 coupled to the associated picture electrodes. If the diodes 27 are exposed to a light source (backlight) 28, which, in this example, is present in the device, a photovoltage $V_F$ is generated in the photovoltaic generator 26. To render the part comprising the generator invisible to the viewer, the device may be covered on the viewing side, at the location of this generator, with a covering edge 29. For this purpose, the photovoltaic generator 26 is preferably situated at the edge of the display device.

The photovoltage $V_F$ is determined by the number (m) of photodiodes 27, which have an average photovoltage $V_F$ of approximately 0.5 to 0.7 volt. During nonselection, the voltage on a pixel 2 must remain the same, which means that, for example if the voltages across the pixels range between a threshold voltage $V_{th}$ and a saturation voltage $V_{sat}$, the data voltages ranging between $-\frac{1}{2}(V_{sat}-V_{th})$ and $+\frac{1}{2}(V_{sat}-V_{th})$, the voltage between the rows 5 and 25 is at least $2.(V_{sat}-V_{th})$. In this case, conduction via the diodes 3, 23 does not occur. In the case of the customary liquid-crystal materials, $2.(V_{sat}-V_{th})$ is approximately 6 volts, so that m is approximately 10.

The surface of the photodiodes can be chosen as a function of the photocurrent to be supplied. For example, for image formats having a diameter of approximately 25 cm or 40 cm or more, the surface of the photodiodes can be adapted to the quantity of current to be supplied to ensure that the pixels switch rapidly enough.

During selection, for example, a pixel is first positively charged (electrode 14 relative to electrode 13) via a diode 3 (which, if necessary, may be in the form of a redundant switch with diodes which are arranged in series or in parallel). To counteract degradation as a result of DC voltages across the liquid-crystal material, the device is preferably operated by means of an AC voltage across the pixels. For this purpose, the data voltages are presented invertedly in each subsequent picture period. Before the pixel is negatively charged during a subsequent selection, the row electrode 5 is provided with a positive voltage in the row period preceding the subsequent selection, so that the pixel 2 is negatively charged via the photogenerator 26 to a voltage at the boundary of the range intended for picture display or beyond this range. In the subsequent selection period, a suitably selected selection voltage is used to charge the pixel to the value corresponding to the applied column voltage.

Figure 4:
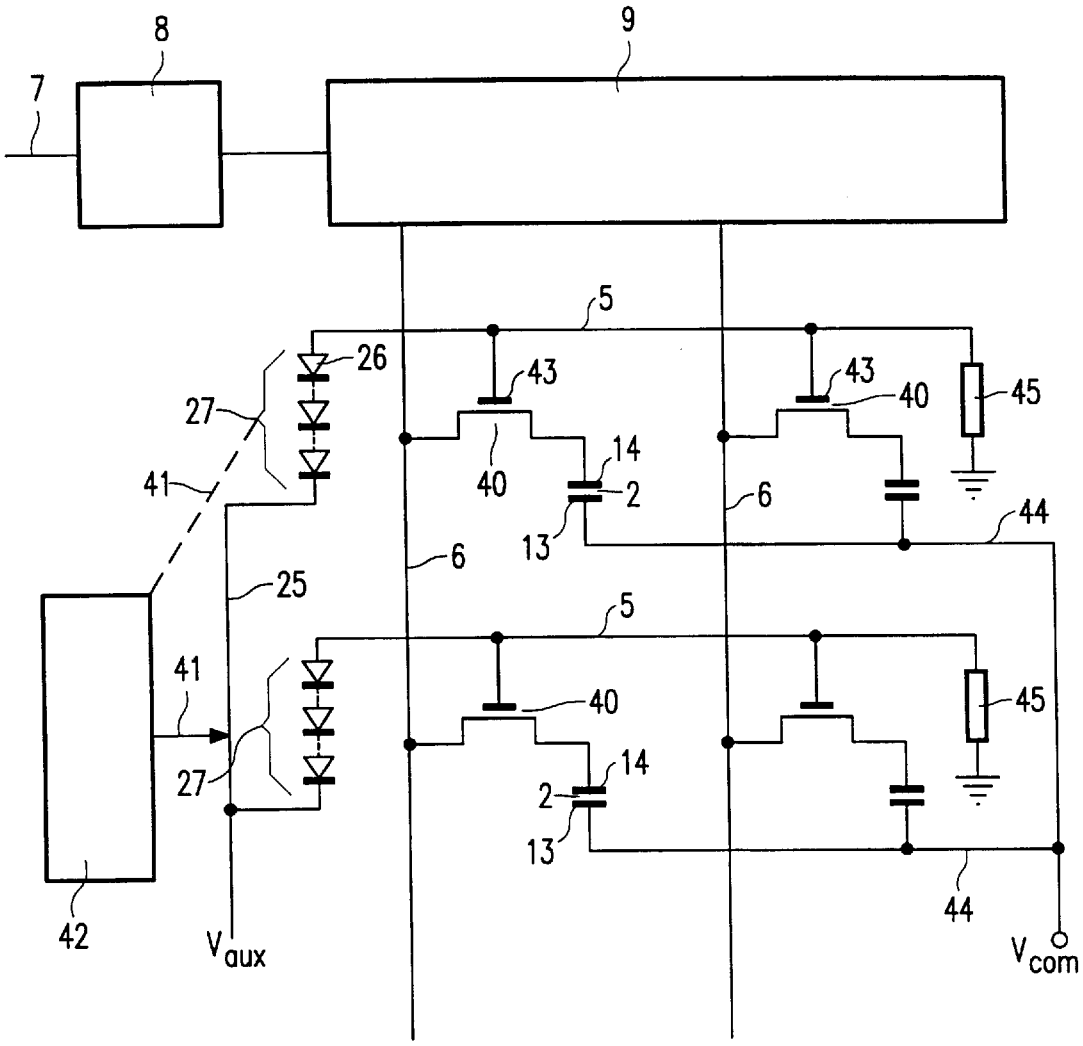

FIG. 4 shows an embodiment of a display device in accordance with the invention, in which thin-film transistors 40 (TFTs) are used as switching elements. For simplicity, only four pixels 2 are shown. A row of pixels is selected again via the row electrodes 5 which select the relevant rows. The row electrodes are each connected to earth via a resistor 45 and are successively provided with a selection voltage by exposing the relevant photovoltaic converter 27 to, for example, a scanning light beam 41, which is generated by means of the light source 42. The photovoltaic converters 27 are arranged between the row electrodes 5 and an electrode 25 for supplying an auxiliary voltage $V_{aux}$, so that, dependent upon exposure or non-exposure to light, the voltage on the gate electrodes 43 of the TFT transistors 40 varies between $V_{aux}+V_F$ and 0 volt. ($V_F$ is the forward voltage of the photovoltaic converter. The number of photodiodes 26 in the photovoltaic converter, which may be limited to one, is determined by the choice of $V_{aux}$). During conduction (selection of the transistors, the capacitances associated with the pixels 2 are charged. For this purpose, each of the transistors 40 is coupled to a picture electrode 14. In this example, the picture electrodes 13 form one common counter electrode 44, which is connected to a fixed potential, in this example $V_{com}$. As the photovoltaic converters are now illuminated selectively, they are shielded from the actual illumination, for example a backlight, for the display device. The use of the scanning light source enables the generally large quantity of row connections to be dispensed with.

Of course, the invention is not limited to the examples shown herein. For example, it is alternatively possible to use a reflective display device in the first example, in which the incident light is modulated for picture display. In this case, the light source (backlight) 28 as well as the covering edge 29 are dispensed with.

In the device shown in FIG. 4, not only data signals can be presented to the column electrodes but also, during one or more (parts of) selection periods, signals for resetting, for example in display devices based on ferro-electric liquid-crystal materials, such as described in U.S. Pat. No. 4,976,515.

It is also possible to use one photovoltaic converter for resetting a number of successive rows of pixels.

The transistors 40 shown in FIG. 4 can also be rendered non-conductive by means of a second photovoltaic converter (instead of the resistor 45), which converter is connected to a suitable voltage source and is illuminated during non-selection.

The resistor 45 (or a photovoltaic converter) can be dispensed with completely if a periodic pulse-shaped voltage $V_{aux}$ is chosen and the illumination of the converter associated with a row is turned off after $V_{aux}$ has reached such a low value that the TFT 40 has become non-conductive.

In summary, the invention relates to a display device in which an internal, auxiliary control voltage is obtained via a photovoltaic converter.

I claim:

1. A display device comprising a first supporting plate a second supporting plate an electro-optical medium between said plates, a plurality of pixels arranged in an array of rows and columns, each pixel comprising a pair of picture electrodes facing each other on respective supporting plates, said picture electrodes being arranged in rows on said first supporting plate and in columns on said second supporting plate, a row electrode connected to each row of picture electrodes on said first supporting plate, a switching element electrically connected between each picture electrode on said first supporting plate and said row electrode, a column electrode connected to each column of picture electrodes on said second supporting plate, an auxiliary voltage electrode corresponding to each row electrode, and a photovoltaic converter electrically connected between each row electrode and the corresponding auxiliary voltage electrode, said photovoltaic converter having a photovoltaic voltage which is high enough to keep the switching element either conductive or non-conductive.

2. A display device as in claim 1 wherein said switching element is a first non-linear two-pole switching element, said device further comprising a second non-linear switching element connected between each picture element on said first supporting plate and the corresponding auxiliary voltage electrode, and drive means for applying a range of data voltages to the column electrodes, said photovoltaic voltage being at least twice said range of data voltages.

3. A display device as in claim 2 further comprising drive means for applying selection voltage to the row electrodes, and means for charging each said pixel to a voltage which is at least said range of data voltage prior to application of said selection voltage.

4. A display device as in claim 1 further comprising a light source.

5. A display device as in claim 1 wherein said switching element is a TFT switching element comprising a gate electrode coupled to the corresponding auxiliary voltage electrode, said photovoltaic voltage being high enough to select said TFT switching element.

6. A display device as in claim 5 further comprising a light source which illuminates photovoltaic converters associated with rows of pixels to be selected.

7. A display device as in claim 6 wherein each said photovoltaic converter comprises lateral diodes.

8. A display device as in claim 1 wherein each said photovoltaic converter comprises a plurality of photosensitive diodes arranged in series.

9. A display device as in claim 1 wherein each said photovoltaic converter is situated outside said array of pixels.

* * * * *